US011441570B2

(12) United States Patent
Hwang et al.

(10) Patent No.: US 11,441,570 B2
(45) Date of Patent: Sep. 13, 2022

(54) MOTOR ASSEMBLY AND METHOD FOR MANUFACTURING THE SAME

(71) Applicant: LG Electronics Inc., Seoul (KR)

(72) Inventors: Eunji Hwang, Seoul (KR); Byungjik Kim, Seoul (KR); Sunggi Kim, Seoul (KR); Jisu Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 128 days.

(21) Appl. No.: 16/816,850

(22) Filed: Mar. 12, 2020

(65) Prior Publication Data

US 2020/0392964 A1 Dec. 17, 2020

(30) Foreign Application Priority Data

Jun. 12, 2019 (KR) ..... 10-2019-0069367

(51) Int. Cl.

| | |
|---|---|
| ***F04D 29/02*** | (2006.01) |
| ***F04D 25/08*** | (2006.01) |
| ***F04D 29/62*** | (2006.01) |
| ***F04D 29/44*** | (2006.01) |
| ***F04D 17/08*** | (2006.01) |
| *F04D 19/00* | (2006.01) |

(52) U.S. Cl.

CPC ..... *F04D 29/023* (2013.01); *F04D 17/08* (2013.01); *F04D 25/08* (2013.01); *F04D 29/441* (2013.01); *F04D 29/622* (2013.01); *F04D 19/002* (2013.01); *F04D 29/444* (2013.01); *F05B 2280/6011* (2013.01); *F05D 2300/611* (2013.01)

(58) Field of Classification Search

None

See application file for complete search history.

(56) References Cited

U.S. PATENT DOCUMENTS

| | | | | |
|---|---|---|---|---|
| 11,028,855 | B2 * | 6/2021 | Hatanaka | C23C 4/10 |
| 2018/0051707 | A1 * | 2/2018 | Hatanaka | F04D 29/622 |
| 2020/0195091 | A1 * | 6/2020 | Kim | H02K 7/14 |

FOREIGN PATENT DOCUMENTS

| | | | | |
|---|---|---|---|---|
| KR | 1020180119032 | | 11/2018 | |
| WO | WO-2018199550 | A1 * | 11/2018 | F04D 29/162 |

* cited by examiner

*Primary Examiner* — Juan G Flores

(74) *Attorney, Agent, or Firm* — Fish & Richardson P.C.

(57) ABSTRACT

An embodiment of the present disclosure discloses a motor assembly including a rotation shaft, an impeller including a hub fastened to the rotation shaft, and a plurality of blades protruding outward from an outer surface of the hub, an inlet body for surrounding an outer circumference of the impeller, and a coating layer coated on an inner surface of the inlet body, wherein at least a portion of the coating layer is ground in a form of powder by friction with the plurality of blades during rotation of the impeller.

19 Claims, 11 Drawing Sheets

MOTOR ASSEMBLY AND METHOD FOR MANUFACTURING THE SAME

CROSS-REFERENCE TO RELATED APPLICATIONS

This application claims the benefit of Korean Patent Application No. 10-2019-0069367, filed on Jun. 12, 2019, which is hereby incorporated by reference as when fully set forth herein.

BACKGROUND

Field

Embodiments of the present disclosure relate to a motor assembly and a method for manufacturing the same, and more particularly, to a motor assembly having an inlet body surrounding an outer circumference of an impeller and a method for manufacturing the same.

Discussion of the Related Art

A motor may be installed in a household appliance, such as a cleaner, a hair dryer, or the like, a vehicle, and the like to function as a driving source for generating a rotational force. The motor may be coupled to a fan, and in this case, the rotational force of the motor is transmitted to the fan to generate airflow based on rotation of the fan. For example, when the motor is installed in the cleaner, the motor may rotate together with the fan to generate a suction force for sucking air.

One example of such a motor may include the motor, an impeller connected to the motor, and an inlet body surrounding an outer circumference of the impeller. The impeller may be fastened to a rotation shaft of the motor, and when the rotation shaft rotates, may rotate inside the inlet body to suck the air into the inlet body.

Specifically, the impeller may include a plurality of blades, and the impeller may be installed inside the inlet body such that there is a tip clearance defined between the blades and an inner surface of the inlet body.

When such tip clearance is too small, there is a risk of friction with the inner surface of the inlet body when the blades rotate. Further, when the tip clearance is too large, leakage flow or vortex may occur at the tip clearance, which may reduce an efficiency of the motor assembly.

PRIOR ART DOCUMENT

Patent Document

Korean Patent Application Publication No. 10-2013-0091841 (published on Aug. 20, 2013)

SUMMARY

A purpose of embodiments of the present disclosure is to provide a motor assembly and a method for manufacturing the same that minimize a tip clearance between an impeller and an inlet body to increase an efficiency of the motor assembly.

Purposes of the present disclosure are not limited to the above-mentioned purpose. Other purposes and advantages of the present disclosure as not mentioned above may be understood from following descriptions and more clearly understood from embodiments of the present disclosure.

Further, it will be readily appreciated that the purposes and advantages of the present disclosure may be realized by features and combinations thereof as disclosed in the claims.

An embodiment of the present disclosure discloses a motor assembly capable of minimizing a tip clearance defined between an impeller and an inlet body by forming a soft coating layer that may be ground in a form of powder on an inner surface of the inlet body.

One aspect of the present disclosure proposes a motor assembly including a rotation shaft, an impeller including a hub fastened to the rotation shaft, and a plurality of blades protruding outward from an outer surface of the hub, an inlet body for surrounding an outer circumference of the impeller, and a coating layer coated on an inner surface of the inlet body, wherein at least a portion of the coating layer is ground in a form of powder by friction with the plurality of blades during rotation of the impeller.

In one implementation, a surface hardness of the coating layer may be less than a surface hardness of the blades.

In one implementation, the impeller may contain polyether ether ketone (PEEK), and the coating layer may contain at least one of ethylene tetra fluoro ethylene (ETFE) and perfluoroalkoxy (PFA).

In one implementation, at least a portion of the coating layer may have a thickness greater than a thickness of a gap defined between the impeller and the inlet body, and a thickness of a remaining portion except for the at least a portion of the coating layer may substantially correspond to the thickness of the gap defined between the impeller and the inlet body.

In one implementation, the coating layer may include a ground portion ground by friction with the plurality of blades during the rotation of the rotation shaft, and a residual portion maintaining a thickness thereof because the friction with the plurality of blades does not occur during the rotation of the rotation shaft.

In one implementation, a thickness of the ground portion may substantially correspond to a thickness of a gap defined between the impeller and the inlet body.

In one implementation, a thickness of the residual portion may be greater than a thickness of a gap defined between the impeller and the inlet body.

In one implementation, each of the plurality of blades may include a leading edge positioned at a front end of the blade with respect to a flow direction of gas flowing into the inlet body, a trailing edge positioned at a rear end of the blade, a blade tip connecting the leading edge and the trailing edge with each other and facing the inner surface of the inlet body, wherein the ground portion may be ground by friction with the blade tip during the rotation of the impeller.

In one implementation, the coating layer may be formed by adsorbing a plurality of paint particles on the inner surface of the inlet body in an electrostatic painting scheme, and an average particle size of the plurality of paint particles may be 20 to 150 μm.

In one implementation, a surface hardness of the coating layer may be 50 to 75 shore D.

In one implementation, a gap defined between the impeller and the inlet body may be variable along a flow direction of gas flowing into the gap, and a thickness of the at least a portion of the coating layer ground during the rotation of the impeller may vary together as the gap defined between the impeller and the inlet body varies.

In one implementation, the coating layer may have a predetermined adhesive force such that the coating layer does not peeled from the inner surface of the inlet body during the rotation of the rotation shaft.

Another aspect of the present disclosure proposes a method for manufacturing a motor assembly including forming a coating layer on an inner surface of an inlet body, inserting an impeller having a plurality of blades into the inlet body, and rotating the impeller, and grinding at least a portion of the coating layer as the impeller rotates, wherein the forming of the coating layer includes adsorbing a plurality of paint particles on the inner surface of the inlet body in an electrostatic painting scheme.

In one implementation, the at least a portion of the coating layer may be ground in a form of powder when the at least a portion of the coating layer is ground as the impeller rotates.

In one implementation, a surface hardness of the coating layer may be less than a surface hardness of the blades.

In one implementation, the impeller may contain polyether ether ketone (PEEK), and the coating layer may contain at least one of ethylene tetra fluoro ethylene (ETFE) and perfluoroalkoxy (PFA).

In one implementation, an average particle size of the plurality of paint particles may be 20 to 150 μm.

In one implementation, the coating layer may include a ground portion ground by friction with the plurality of blades during the rotation of the rotation shaft, and a residual portion maintaining a thickness thereof because the friction with the plurality of blades does not occur during the rotation of the rotation shaft, wherein a thickness of the ground portion may be greater than a thickness of a gap defined between the impeller and the inlet body, and wherein a thickness of the residual portion may substantially correspond to the thickness of the gap defined between the impeller and the inlet body.

In one implementation, before the rotating of the impeller, the thickness of the ground portion may be substantially equal to the thickness of the residual portion.

In one implementation, after the rotating of the impeller, the thickness of the ground portion may become substantially equal to the thickness of the gap defined between the impeller and the inlet body when the ground portion is ground as the impeller rotates.

The features of the above-described implantations may be combined with other embodiments as long as they are not contradictory or exclusive to each other.

Effects of the present disclosure are as follows but are limited thereto.

In the motor assembly and the method for manufacturing the same according to embodiments of the present disclosure as described above, a leakage flow from a pressure-side surface to a suction-side surface of the blades by a pressure difference may be minimized to reduce a flow loss and an efficiency of the motor assembly may be improved.

Further, even when there are an injection molding error of the blades and an assembly tolerance of the motor assembly, such error or tolerance may be compensated based on a grinding depth of the coating layer, and the minimum tip clearance may be maintained, so that the reliability of the motor assembly may be improved.

Further, even when the thrust force of the impeller increases during use of the motor assembly, and the impeller approaches the coating layer, a portion of the remaining coating layer may be smoothly ground to cope with a sudden increase in the thrust force.

In addition, when the coating layer is ground by the blades, the coating layer may be ground in the form of the powder, so that the coating layer may be accurately ground without being excessively ground.

In addition, because the coating layer has a surface hardness smaller than that of the blades, even when the coating layer is ground by the blades, there is no risk of the blades being worn or broken by the coating layer.

In addition, because the coating layer is made of the soft material, even when an output of the motor assembly is somewhat low, the coating layer may be smoothly ground.

BRIEF DESCRIPTION OF DRAWINGS

Embodiments of the present disclosure may be easily understood by a combination of a following detailed description and accompanying drawings. Further, reference numerals refer to structural elements.

DETAILED DESCRIPTION

Figure 1:
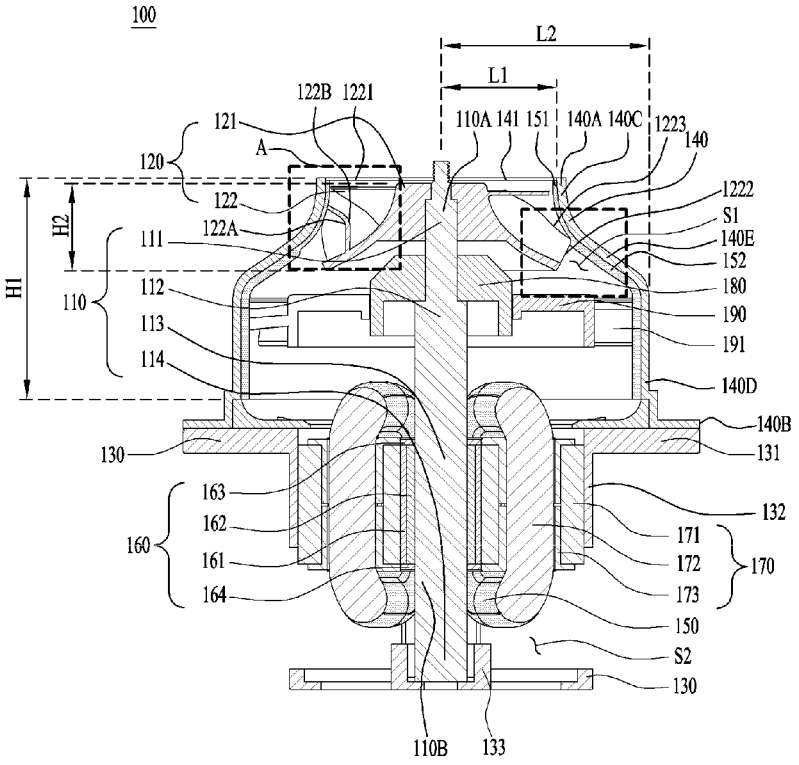
FIG. 1 is a cross-sectional view illustrating each component of a motor assembly according to an embodiment of the present disclosure.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
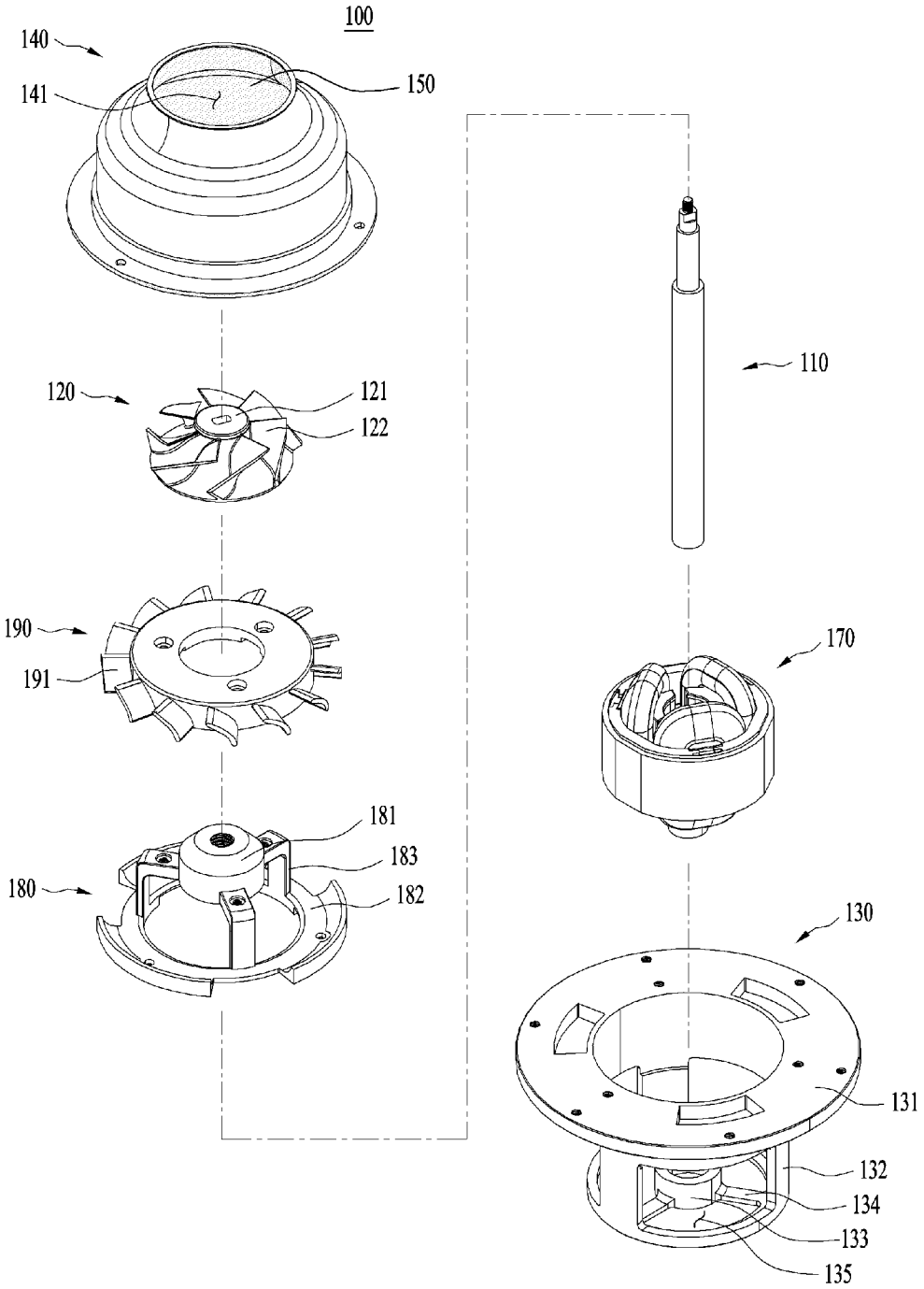
FIG. 2 is an exploded perspective view illustrating the motor assembly shown in FIG. 1.
Figure 3:
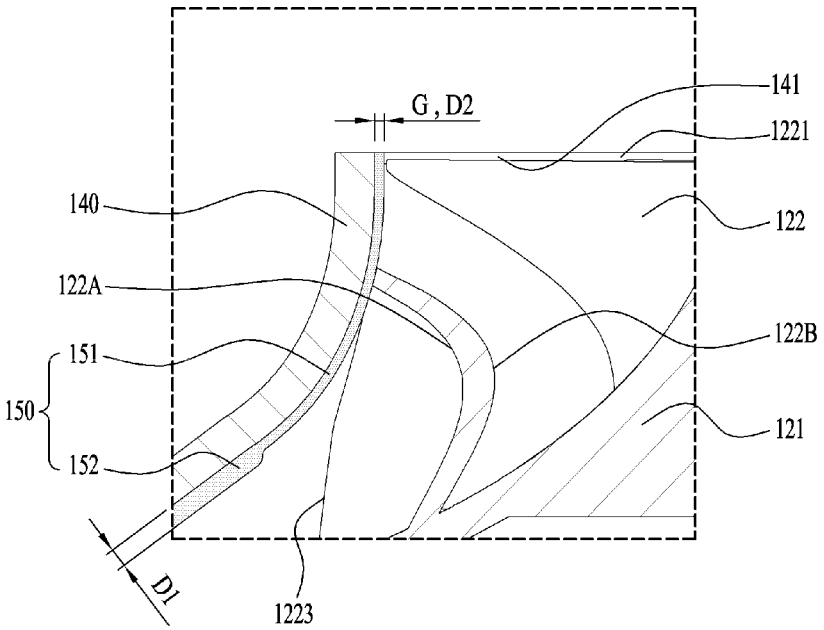
FIG. 3 is an enlarged cross-sectional view enlarging a portion A in FIG. 1.
Figure 4:
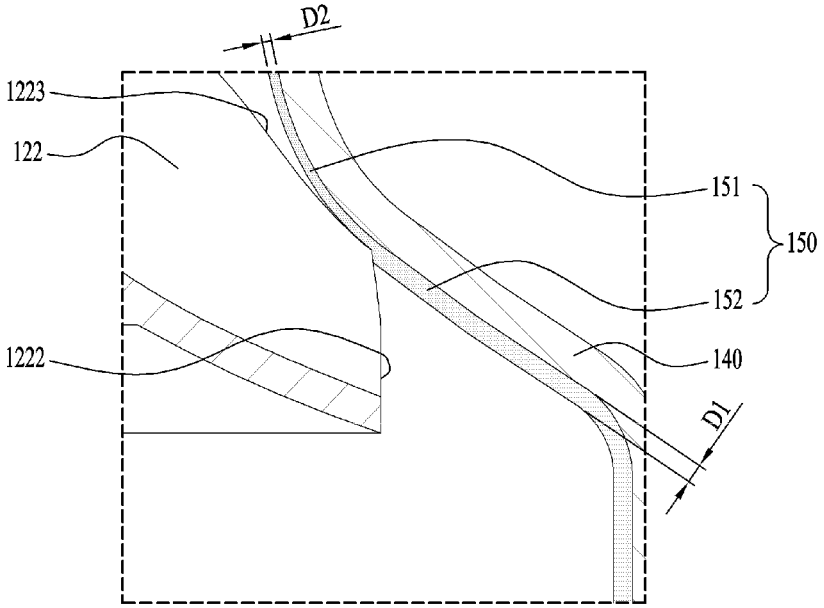
FIG. 4 is an enlarged cross-sectional view enlarging a portion B in FIG. 1.

FIG. 1 is a cross-sectional view illustrating each component of a motor assembly according to an embodiment of the present disclosure. Further, FIG. 2 is an exploded perspective view illustrating the motor assembly shown in FIG. 1. Further, FIG. 3 is an enlarged cross-sectional view enlarging a portion A in FIG. 1. Further, FIG. 4 is an enlarged cross-sectional view enlarging a portion B in FIG. 1.

Referring to FIGS. 1 and 2, a motor assembly 100 according to an embodiment of the present disclosure may include a rotation shaft 110, an impeller 120, a motor housing 130, an inlet body 140, a coating layer 150, a rotor 160, a stator 170, a first bearing bracket 180, and a diffuser 190, and these components may be installed inside the motor housing 130 and the inlet body 140 forming an outer shape of the motor assembly 100.

First, the rotation shaft 110 may extend to cross an impeller space 51 and a motor space S2 in an axial direction L. Specifically, one side 110A of the rotation shaft 110 may be disposed at a side of the inlet body 140, and the other side 110B of the rotation shaft 110 may be disposed at a side of the motor housing 130.

Specifically, the rotation shaft 110 may include an impeller coupling portion 111 and a first support 112, a rotor coupling portion 113, and a second support 114.

The impeller coupling portion 111 is a portion of the rotation shaft 110 on which the impeller 120 is installed, and is a portion adjacent to the one side 110A of the rotation shaft 110. The impeller coupling portion 111 may be disposed in the impeller space 51 defined inside the inlet body 140.

The first support 112 is a portion of the rotation shaft 110 which faces the first bearing bracket 180 along a radial direction R of the rotation shaft 110. The first support 112 may be a portion of the rotation shaft 110 corresponding to a portion between the impeller coupling portion 111 and the rotor coupling portion 113.

The rotor coupling portion 113 is a portion of the rotation shaft 110 on which the rotor 160 is installed, and is a portion of the rotation shaft 110 corresponding to a portion between the first support 112 and the second support 114. The rotor coupling portion 113 may be disposed in the motor space S2 defined in the motor housing 130.

The second support 114 is a portion of the rotation shaft 110 which faces the second bearing bracket 133 along the radial direction R of the rotation shaft 110, which means a portion extending from the rotor coupling portion 113 along the axial direction of the rotation shaft 110 to the other side 110B of the rotation shaft 110.

Specifically, the first support 112 of the rotation shaft 110 may be accommodated in the first bearing bracket 180, and a bearing (not shown) having a coupling hole defined therein into which the rotation shaft 110 may be inserted may be installed in the first bearing bracket 180.

In addition, the second support 114 of the rotation shaft 110 may be accommodated in the second bearing bracket 133 of the motor housing 130, and a bearing (not shown) having a coupling hole defined therein into which the rotation shaft 110 may be inserted may be installed in the second bearing bracket 133.

That is, the first support 112 and the second support 114 of the rotation shaft 110 may be supported by the bearings accommodated in the first bearing bracket 180 and the second bearing bracket 133, respectively.

Although not shown in the drawings, as an example, the bearings respectively installed in the first bearing bracket 180 and the second bearing bracket 133 may be rolling bearings. Each bearing may include each outer ring (not shown) press-fitted and fixed on an inner circumferential face of each of the first bearing bracket 180 and the second bearing bracket 133, each inner ring (not shown) fastened to an outer circumferential face of the rotation shaft 110, and each rolling member interposed between each inner ring and each outer ring, and allowing degrees of freedom for each inner ring and each outer ring to slide with respect to each other.

In addition, each bearing may be a gas bearing for supporting the rotation shaft 110 by gas with a high pressure formed between the housing and the bearing when the rotation shaft 110 rotates at a high speed.

As such, each of the first bearing bracket 180 and the second bearing bracket 133 may serve as a kind of rotation shaft supporter for supporting each of the first support 112 and the second support 114 of the rotation shaft 110 together with each of the bearings installed in the first bearing bracket 180 and the second bearing bracket 133.

The impeller 120 may be installed on the rotation shaft 110 to be spaced apart from the rotor 160 by a predetermined spacing along the axial direction L of the rotation shaft 110. As described above, the impeller 120 may be installed on the impeller coupling portion 111 of the rotation shaft 110 and rotated together with the rotation shaft 110 when the rotation shaft 110 rotates, and may be disposed in the impeller space 51 disposed in the inlet body 140.

For example, the impeller 120 may be a diagonal flow type impeller that sucks the gas such as air in the axial direction L of the rotation shaft 110 and discharges the gas in an oblique direction between a centrifugal direction and the axial direction. That is, the gas flowing into the inlet body 140 through the inlet 141 may be guided toward the motor housing 130 along an outer surface of a hub 121 as blades 122 rotate. However, embodiments of the present disclosure are not limited thereto, and the impeller 120 may be configured as a centrifugal impeller that sucks the gas in the axial direction and discharges the gas in the centrifugal direction. However, hereinafter, for convenience of description, the impeller 120 will be described based on a case of the diagonal flow type impeller.

Specifically, the impeller 120 may include the hub 121 fastened to the rotation shaft 110, and the plurality of blades 122 protruding outward from an outer circumference of the hub 121. In one example, the impeller 120 may be made of a high strength synthetic resin material such as polyether ether ketone (PEEK) as a material thereof.

A hollow (not shown) in which the rotation shaft 110 is inserted may be defined at a center of the hub 121. Further, the hub 121 may have a shape in which an outer diameter thereof gradually increases towards the rotor 160. That is, the outer diameter of the hub 121 may be the smallest at one end thereof that is close to the inlet 141, and may be the largest at the other end thereof close to the rotor 160. The largest outer diameter of the hub 121 may be an outer diameter of the end of the hub 121 close to the rotor 160.

The plurality of blades 122 may be formed on the outer surface of the hub 121, and the plurality of blades 122 may be installed to be spaced apart from each other at predetermined spacings along a circumferential direction of the impeller 120.

Specifically, the blade 122 may be formed in a curved plate shape, and both faces thereof may be divided into a pressure-side surface 122A and a suction-side surface 122B.

The blade 122 may be formed in a three-dimensional shape, and may include a leading edge 1221 at a most upstream side, that is, at a front end of the blade 122 with respect to a flow direction of the gas, and a trailing edge 1222 at a most downstream side, that is, at a rear end of the blade 122 with respect to the flow direction of the gas.

In addition, the blade 122 may further include a blade tip 1223 positioned at an outermost side of the blade 122 with respect to a central axis of the hub 121. That is, the blade tip 1223 may be an outer tip positioned at the outermost side of the blade 122.

In the blade 122, the leading edge 1221 and the trailing edge 1222 may be connected to each other by the blade tip 1223. The blade tip 1223 may connect a tip of the leading edge 1221 farthest to the hub 121 with a tip of the trailing edge 1222 farthest to the hub 121.

The blade tip 1223 may include an inlet facing region 1223A facing the inlet 141 in the axial direction, and a coating layer facing region 1223B facing the coating layer 150 in the axial direction. In addition, an entirety of the blade tip 1223 may face the coating layer 150 in the radial direction.

When the impeller 120 rotates, Some of the gas flowing by the impeller 120 may flow over the blade tip 1223 by a pressure difference between the pressure-side surface 122A and the suction-side surface 122B of the blade 122, and such flow may become leakage flow.

When the impeller 120 rotates, a periphery of the pressure-side surface 122A may be a relatively high pressure, and a periphery of the suction-side surface 122B may be a relatively low pressure. When a tip clearance G between the blade tip 1223 and the inner surface of the inlet body 140 is large, gas around the pressure-side surface 122A may flow over the blade tip 1223 to the periphery of the suction-side surface 122B, and a vortex may be formed periphery of the suction-side surface 122B.

When the tip clearance between the blade tip 1223 and the inlet body 140 is large, an amount of the leakage flow increases, so that such tip clearance is preferably set to minimize the leakage flow.

In order to minimize such tip clearance, the coating layer 150 may be interposed between the blade tip 1223 and the inlet body 140. The coating layer 150 may be previously formed on the inner surface of the inlet body 140 before assembling the motor assembly 100. Further, a portion of the coating layer 150 may be ground by the rotation of the blade 122 of the impeller 120 when assembling the motor assembly 100. The coating layer 150 will be described in more detail below.

The motor housing 130 may accommodate the rotation shaft 110, the rotor 160, and the stator 170 therein, and may be formed to surround the outer circumference of the stator 170 to be fastened to the inlet body 140. In detail, the motor housing 130 may have the motor space S2 defined therein in which the other side 110B of the rotation shaft 110, the rotor 160, and the stator 170 may be accommodated.

Specifically, the motor housing 130 may include a first fastening portion 131 extending in the radial direction R of the rotation shaft 110 and fastened to the inlet body 140, a motor housing portion 132 extending in the axial direction L of the rotation shaft 110 from an interior of the first fastening portion 131, the second bearing bracket 133 in which the bearing (not shown) connected to the motor housing portion 132 at the other side 110B of the rotation shaft 110 to support the second support 114 of the rotation shaft 110 in the radial direction R of the rotation shaft 110 is installed, and a motor housing bridge 134 connecting the motor housing 132 and the second bearing bracket 133 with each other.

In addition, the motor housing 130 may include an outlet 135 through which the gas guided from the impeller space 51 to the motor space S2 by the rotation of the impeller 120 is discharged to the outside of the motor housing 130, and the outlet 135 may be defined at the opposite side of the inlet 141 with respect to a flow direction of the gas.

The inlet body 140 may include an inlet 141 through which the gas is sucked, and may be disposed to surround an outer circumference of the impeller 120. That is, the impeller space 51 in which the impeller 120 is rotatably disposed may be defined inside the inlet body 140. Further, an outer surface of the inlet body 140 may correspond to a shape of the impeller 120, and an inner surface of the inlet body 140 may be curved so as to stably guide the gas flowing along the impeller space 51.

Specifically, a side opposite to the inlet 141 of the inlet body 140 may be fastened to the motor housing 130 to form the outer shape of the motor assembly 100. The inlet body 140 and the motor housing 130 may be fastened to be in close contact with each other such that the gas flowing inside the motor assembly 100 does not leak. That is, it is preferable to fasten the inlet body 140 and the motor housing 130 with each other tightly such that no gap is defined between the inlet body 140 and the motor housing 130. Further, as a fastening scheme, various schemes, for example, screwing, fitting, and the like, may be used, but is not limited to one particular scheme.

The motor housing 130 and the inlet body 140 described above may be a kind of casing having a hollow therein, and the rotation shaft 110 may extend in the axial direction L in an empty space at a center of the motor housing 130 and the inlet body 140.

Further, the inlet body 140 may be formed such that an inner diameter thereof increases along the flow direction of the gas. The inlet body 140 is for guiding the gas to be sucked into the impeller 120, and an inner diameter L1 of one end 140A of the inlet body 140 and an inner diameter L2 of the other end 140B of the inlet body 140 may be different in structure. That is, the inner diameter L2 of the other end 140B of the inlet body 140 may be larger than the inner diameter L1 of the one end 140A of the inlet body 140.

The inlet body 140 may be formed such that the inner diameter thereof gradually increases from the one end 140A to the other end 140B.

One example of the inlet body 140 may be formed such that an inner diameter of an entire region between the one end 140A and the other end 140B thereof gradually expands along the flow direction of the gas. In addition, the impeller 120 may be disposed inside such inlet body 140. Further, an entirety of the blade tip 1223 may be formed to face the inner surface of the inlet body 140 along the radial direction of the rotation shaft 110.

Another example of the inlet body 140 may include a small diameter portion 140C, a large diameter portion 140D, and an extension 140E.

The small diameter portion 140C may include the one end 140A of the inlet body 140, and an inner diameter thereof may be smaller than an inner diameter of the large diameter portion 140D. The inlet 141 through which the gas outside the motor assembly 100 flows into the inlet body 140 may be defined inside the small diameter portion 140C.

The large diameter portion 140D may include the other end 140B of the inlet body 140, and the inner diameter thereof may be larger than the inner diameter of the small diameter portion 140C.

The extension 140E may connect the small diameter portion 140C and the large diameter portion 140D with each other, and may be formed such that an inner diameter of the extension 140E gradually increases. The extension 140E may be located between the small diameter portion 140C and the large diameter portion 140D in the flow direction of the gas. Further, the gas may flow through the interior of the small diameter portion 140C and flow into the extension 140E, and may flow into the large diameter portion 140D from the extension 140E. Further, the impeller 120 may be located inside the small diameter portion 140C and inside the extension 140E. Further, a portion of the blade tip 1223 may face the small diameter portion 140C in the radial direction, and another portion of the blade tip 1223 may face the extension 140E in the radial direction.

Another example of the inlet body 140 may include the large diameter portion 140D and the extension 140E without the small diameter portion 140C. In this case, the extension 140E may include the one end 140A of the inlet body 140, and the inlet 141 through which the external gas is sucked into the motor assembly 100 may be defined in the extension 140E. Further, the inner diameter of the extension 140E may gradually increase in a direction to be closer to the large diameter portion 140D. In addition, the impeller 120 may be located inside the extension 140E, and the blade tip 1223 may face the extension 140E in the radial direction. In addition, the inlet body 140 may be integrally formed with the motor housing 130.

The coating layer 150 may be coated on the inner surface of the inlet body 140. The coating layer 150 may not be ground by a separate grinding process, and may be ground by the blades 122 of the impeller 120 when the motor assembly 100 is assembled. That is, a portion of the coating layer 150 may be peeled by the blades 122 when the motor assembly 100 is assembled. The coating layer 150 may be a kind of sacrificial coating.

In order to be smoothly ground by the blades 122, the coating layer 150 may be made of a material such that a surface hardness of the coating layer 150 is smaller than a surface hardness of the blades 122. Most preferably, the coating layer 150 may be made of a material that may be ground to be in a form of powder when being ground by the blades 122. Accordingly, when the blades 122 rotate, a portion of the coating layer 150 may be ground to be in the form of the powder by the blades 122 without being ploughed or penetrated.

Specifically, the impeller 120 may contain polyether ether ketone (PEEK), and the coating layer 150 may contain at least one of ethylene tetra fluoro ethylene (ETFE) and perfluoroalkoxy (PFA).

The surface hardness of the coating layer 150 may be 50 to 75 shore D (shore hardness). In other words, when a force is applied in a direction perpendicular to a surface of the coating layer 150 using a pressing needle having an acute angle of 30 degrees formed by a cut face of one end thereof, a repulsive force applied from the coating layer 150 to the pressing needle may be 22.25 to 33.375 N.

When the surface hardness of the coating layer 150 is less than 50 shore D, the coating layer 150 is badly worn, and thus, a gap defined between the coating layer 150 and the blade tip 1223 becomes large, thereby deteriorating an efficiency of the motor assembly 100. In addition, when the surface hardness of the coating layer 150 greater than 75 shore D, the grinding of the coating layer 150 by the blade tip 1223 may not be smoothly performed or the blade tip 1223 may be worn or broken.

In one example, it is preferable that the coating layer 150 is coated to cover a portion of the leading edge 1221, an entirety of the blade tip 1223, and a portion of the trailing edge 1222 along the flow direction of the gas.

To this end, a vertical dimension H1 of the coating layer 150 may be greater than a vertical dimension H2 of the impeller 120. In this connection, the vertical dimension H1 of the coating layer 150 and the vertical dimension H2 of the impeller 120 may be lengths along the axial direction of the rotation shaft 110. In addition, when assembling the motor assembly 100, the coating layer 150 may be disposed to surround an entirety of an outer circumference face of the impeller 120.

At least a portion of the coating layer 150 may have a thickness D1 that is greater than a thickness of the tip clearance G between the impeller 120 and the inlet body 140. Further, a thickness D2 of the remaining portion of the coating layer 150 excluding the at least a portion of the coating layer 150 may have a thickness substantially corresponding to the thickness of the tip clearance G between the impeller 120 and the inlet body 140.

Specifically, the coating layer 150 may include a ground portion 151 ground by a friction with the plurality of blades 122 when the rotation shaft 110 rotates, and a residual portion 152 maintaining a thickness thereof because the friction with the plurality of blades 122 does not occur when the rotation shaft 110 rotates.

That is, the ground portion 151 is ground by the plurality of blades 122 as the rotation shaft 110 rotates. As a result, the ground portion 151 may be formed to have the thickness D2 substantially corresponding to the tip clearance G defined between the impeller 120 and the inlet body 140. In addition, the residual portion 152 is not rubbed with the rotation shaft 110 when the rotation shaft 110 rotates, so that the thickness of the residual portion 152 may be maintained. Thus, the residual portion 152 may have the thickness D1 greater than the thickness of the tip clearance G defined between the impeller 120 and the inlet body 140.

It is preferable that the coating layer 150 is formed to have the thickness D1, which is considering all of a depth to be ground by the blades 122, an assembly tolerance of the impeller 120, and the like without significantly increasing a weight of the motor assembly 100. That is, the coating layer 150 may have the thickness at least greater than the thickness of the tip clearance G defined between the impeller 120 and the inlet body 140.

Specifically, the coating layer 150 may be formed by adsorbing a plurality of paint particles on the inner surface of the inlet body 140 in an electrostatic painting scheme. In this connection, an average particle size of the paint particles may be 20 to 150 μm.

In addition, the tip clearance G between the impeller 120 and the inlet body 140 may vary along the flow direction of the gas flowed into the tip clearance G. That is, the thickness D2 of the ground portion 151 of the coating layer 150 excluding the residual portion 152 may vary together as the tip clearance G between the impeller 120 and the inlet body 140 varies.

That is, the thickness of the ground portion 151 may be substantially constant without a point where the thickness of the ground portion 151 changes rapidly along a gas flow path, or may be substantially the same as the thickness of the tip clearance G between the impeller 120 and the inlet body 140.

In addition, the coating layer 150 may have a predetermined adhesive force such that the coating layer 150 does not peeled from the inner surface of the inlet body 140 when the rotation shaft 110 rotates.

The rotor 160 may be installed on the rotor coupling portion 113 of the rotation shaft 110. The rotor 130 may be coupled to the rotation shaft 110 to surround an outer circumferential face of the rotation shaft 110, and may be disposed in the motor space S2 in which the rotor coupling portion 113 is disposed.

Specifically, the rotor 160 may include a magnet 161 and a magnet core 162 on which the magnet 161 is mounted. In addition, the rotor 160 may further include a first end plate 163 and a second end plate 164 spaced apart from each other by a predetermined spacing along the axial direction L of the rotation shaft 110.

The first end plate 163 and the second end plate 164 may be installed on the rotation shaft 110 to surround the rotation shaft 110, and may respectively support both ends of the magnet 161 and the magnet core 162 with respect to the axial direction L of the rotation shaft 110 to firmly fix the magnet 161 and the magnet core 162 to the rotation shaft 110 such that the magnet 161 and the magnet core 162 do not move along the axial direction L.

The stator 170 may be installed inside the motor housing 130 to surround an outer face of the rotor 160 such that the stator 170 is spaced apart from the rotor 160 by a predetermined spacing along the radial direction R of the rotation shaft 110. Further, the stator 140 may be disposed in the motor space S2 in which the rotor coupling portion 113 of the rotation shaft 110 is located, like the rotor 130.

Specifically, the stator 170 may include a stator core 171 installed inside the motor housing 130 such that the stator core 171 surrounds an outer face of the rotor 160 and is spaced from the rotor 160 by a predetermined spacing, a coil 172 wound around the stator core 171, and an insulator 173 interposed between the stator core 171 and the coil 172 to electrically insulate the stator core 171 and the coil 172.

The first bearing bracket 180 may have a through hole (not shown) defined therein through which the rotation shaft 110 passes, and the first bearing bracket 180 may be installed inside the inlet body 140, and between the impeller 120 and the rotor 160. As described above, the first support 112 of the rotation shaft 110 may be accommodated in the internal space of the first bearing bracket 180.

Specifically, the first bearing bracket 180 may include a bearing housing portion 181 for accommodating the first support 112 of the bearing and rotation shaft 110 therein, a second fastening portion 182 fastened to the motor housing 130 through a fastening member (not shown) such as a screw and the like, and a bearing housing bridge 183 for connecting the bearing housing portion 181 and the second fastening portion 182 with each other.

The diffuser 190 may be installed between the impeller 120 and the motor housing 130, and may be fastened and fixed to the first bearing bracket 180 through a fastening member (not shown) such as a bolt and a nut. A predetermined space through which the gas flowed into the inlet body 140 through the inlet 141 may flow may be defined between the diffuser 190 and the inlet body 140.

A plurality of diffuser vanes 191 protruding toward an inner surface of the inlet body 140 may be formed on an outer surface of the diffuser 190. The plurality of diffuser vanes 191 may convert a dynamic pressure of the gas passing through the impeller 120 into a static pressure.

The plurality of diffuser vanes 191 may be arranged on the outer circumferential face of the diffuser 190 to be spaced from each other at a substantially the same spacing along a circumferential direction, but embodiments are not limited thereto. For example, spacings between two adjacent diffuser vanes 191 may gradually increase and then decrease, or may decrease and then increase. Further, the spacings between two adjacent diffuser vanes 1951 may be different from each other.

The gas flowed into the inlet body 140 through the inlet 141 may be guided into a space between the inlet body 140 and the diffuser 190 by the impeller 120, and the gas flowed to the space between the inlet body 140 and the diffuser 190 may be guided to the motor space S2 by the plurality of diffuser vanes 191.

Figure 5:
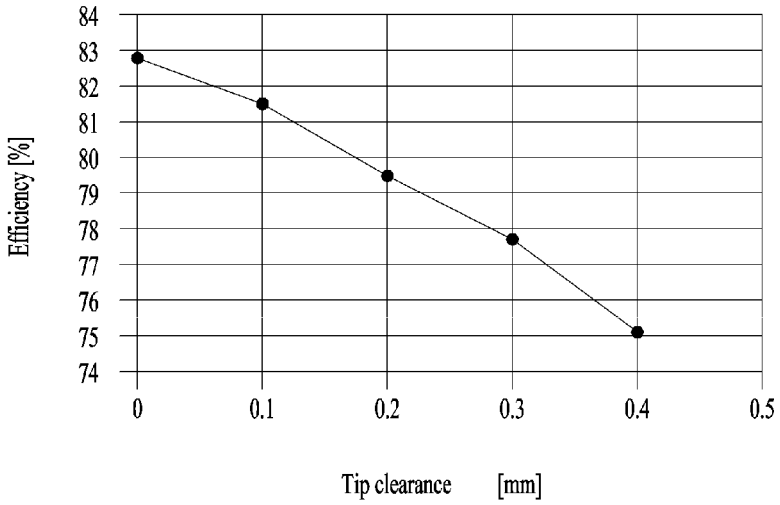
FIG. 5 is a graph showing an efficiency of a motor assembly based on a tip clearance defined between an impeller and an inlet body.

FIG. 5 is a graph showing an efficiency of a motor assembly based on a tip clearance defined between an impeller and an inlet body.

Referring to FIG. 5, an X axis means the tip clearance G between the blade tip 1223 of the impeller 120 and the inner surface of the inlet body 140, and a Y axis means an efficiency of the motor assembly 100.

Specifically, when the thickness of the tip clearance G defined between the blade tip 1223 and the inlet body 140 is 0.4 mm (i.e., 400 μm), the efficiency of the motor assembly 100 is 75%, when the thickness of the tip clearance G is 0.3 mm (i.e., 300 μm), the efficiency of the motor assembly 100 increases by about 3% to about 78%, when the thickness of the tip clearance G is 0.2 mm (that is, 200 μm), the efficiency of the motor assembly 100 increases about 1.5% to 79.5%, when the thickness of the tip clearance G is 0.1 mm (i.e., 100 μm), the efficiency of the motor assembly 100 increases by 2% again to 81.5%, and when the tip clearance G does not exist, the efficiency of the motor assembly 100 increases to about 83%.

That is, when the tip clearance G does not exist compared to the case where the thickness of the tip clearance G is 400 μm, the efficiency of the motor assembly 100 may increase by about 8% from 75% to 83%. The reason why the efficiency of the motor assembly 100 is lowered when the tip clearance G exists is because, as described above, when the tip clearance G exists, gas around the pressure-side surface 122A of the blade 122 flows over the blade tip 1223 to around the suction-side surface 122B, and thus, the vortex is formed around the suction-side surface 122B to generate the leakage flow.

As mentioned above, in an embodiment of the present disclosure, the tip clearance G defined between the blade tip 1223 and the inlet body 140 may be filled with the coating layer 150 having a thickness substantially equal to the thickness of the tip clearance G, that is, the ground portion 151, so that, when the coating layer 150 is formed on the inner surface of the inlet body 140, substantially no tip clearance G may exist. Accordingly, the motor assembly 100 according to an embodiment of the present disclosure may expect an efficiency increase of nearly 10% than that in the case where the tip clearance G exists.

Figure 6:
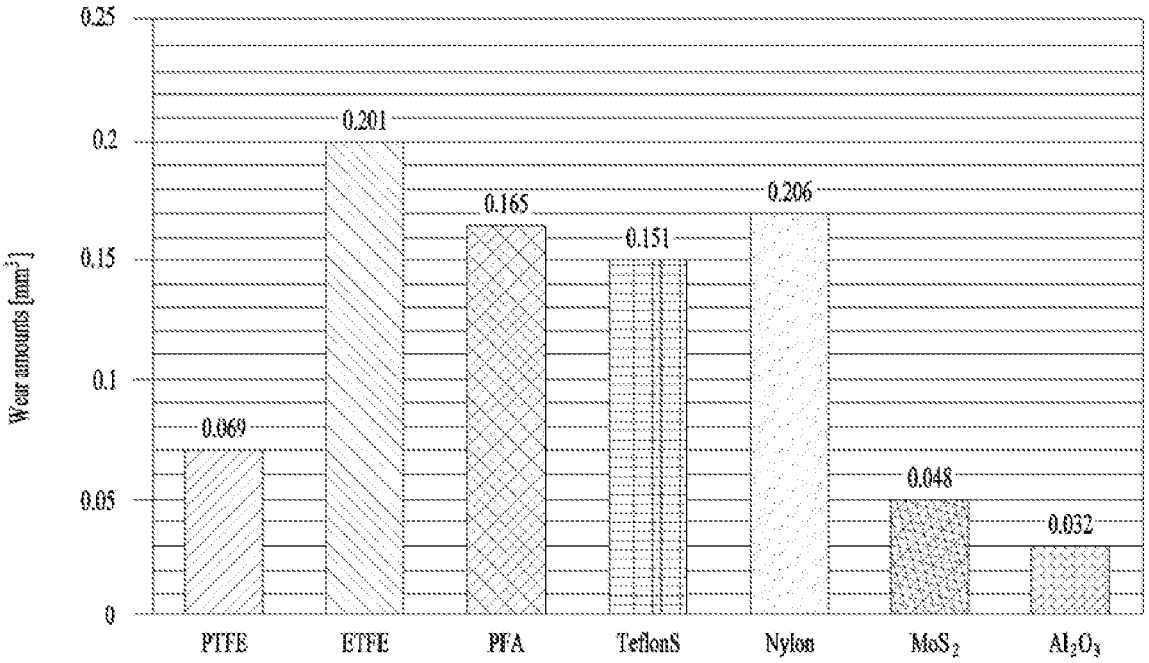
FIG. 6 is a graph showing wear amounts of coating layers worn by rotating an impeller after the coating layers are made of various materials.

FIG. 6 is a graph showing wear amounts of coating layers worn by rotating an impeller after the coating layers are made of various materials.

Referring to FIG. 6, various materials that may be used as the coating layer 150 are listed by type on an X axis, and a Y axis represents a wear amount ($m^3$) of each material.

The graph shown in FIG. 6 is an experimental result derived from a Pin on Disk friction/wear test, which is a result of rotating a disk at a rotational speed of 10 Hz around a rotation shaft rotating along a circle with a radius of 5 mm, then coating each of the materials listed on the X axis on the rotating disk, and then approaching a ball in a vertical direction to press the coating layer coated on the disk with a load of 5 N, and rotating the disk 1500 times to rub the ball and the coating layer by a length of 15.8 m.

When examining the graph specifically, it may be seen that when polytetrafluoroethylene (PTFE) was used as the material of the coating layer, a wear amount was 0.069 $m^3$, when ethylene tetra fluoro ethylene (ETFE) was used as the material, a wear amount was 0.201 $m^3$, when perfluoroalkoxy (PFA) was used as the material, a wear amount was 0.165 $m^3$, when Teflon-S was used as the material, a wear amount was 0.151 $m^3$, when nylon was used as the material, a wear amount was 0.206 $m^3$, when molybdenum disulfide ($MoS_2$) was used as the material, a wear amount was 0.048 $m^3$, and when aluminum oxide ($Al_2O_3$) was used as the material, a wear amount was 0.032 $m^3$.

In other words, as a result of the Pin on Disk friction/wear test, it may be seen that an order of the wear amounts, from the highest to the lowest, is the Nylon, the ETFE, the PFA, the Teflon-S, the PTFE, the $MoS_2$, and the $Al_2O_3$. Among them, the ethylene tetra fluoro ethylene (ETFE) and perfluoroalkoxy (PFA) are soft materials, which may be worn to be in the form of the powder upon friction with the blades 122, and may be coated on the inner surface of the inlet body 140 in the electrostatic painting scheme unlike other materials.

However, because a coatable thickness of the ethylene tetra fluoro ethylene (ETFE) is 400 μm or more, the tip clearance G may be sufficiently filled even when the tip clearance G is somewhat large. However, because a coatable thickness of the perfluoroalkoxy (PFA) is about 150 μm, the tip clearance G may not be sufficiently filled when the thickness of the tip clearance G is equal to or larger than 150 μm. In one example, when the thickness of the tip clearance G is less than 150 μm, not only the ethylene tetra fluoro ethylene (ETFE) but also the perfluoroalkoxy (PFA) may be used as a suitable material for the coating layer 150.

That is, the ethylene tetra fluoro ethylene (ETFE) may be used almost universally as a suitable material of the coating layer 150. However, the perfluoroalkoxy (PFA) may be used as the material of the coating layer 150 when the motor assembly 100 is miniaturized and weight lightened, and the thickness of the tip clearance G less than 150 μm.

Hereinafter, a method for forming the coating layer 150 on the inner surface of the inlet body 140 will be described in detail with reference to FIGS. 7 to 11.

Figure 7:
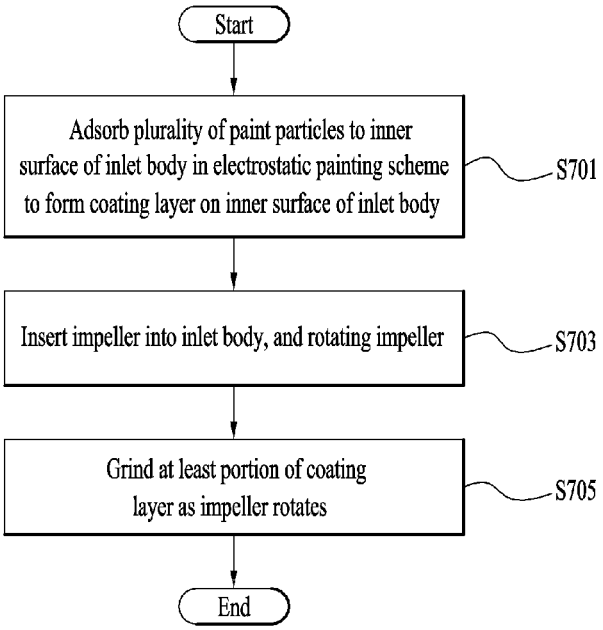
FIG. 7 is a flowchart schematically illustrating a method for forming a coating layer illustrated in FIG. 1.
Figure 8:
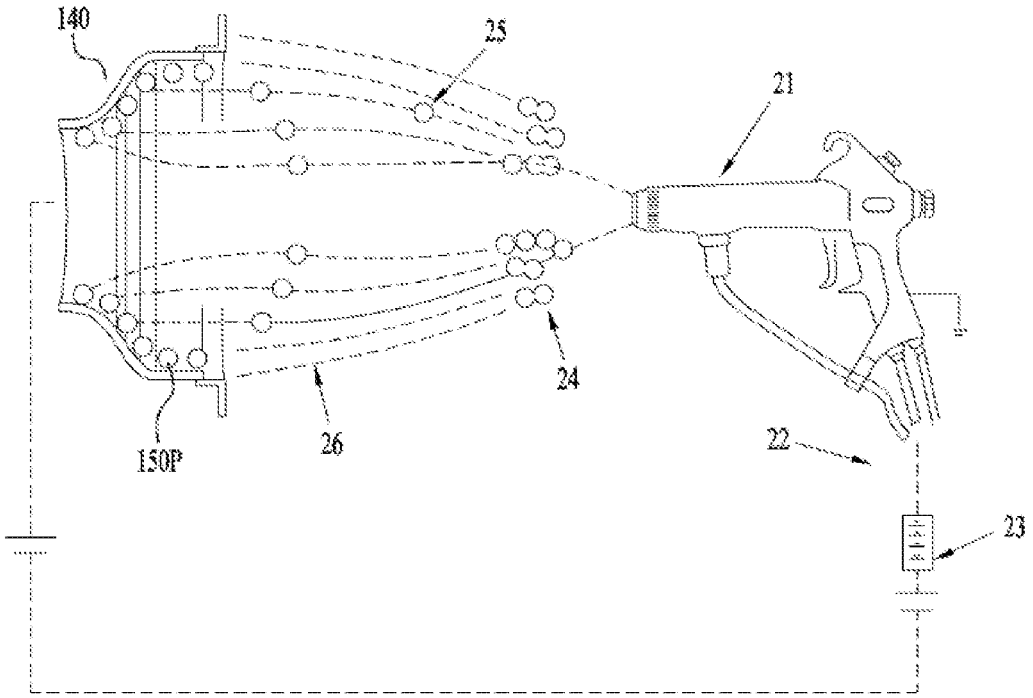
FIG. 8 is a conceptual diagram schematically illustrating a state in which a coating layer is formed by applying paint on an inlet body illustrated in FIG. 1 using an electrostatic painting scheme.
Figure 9A:
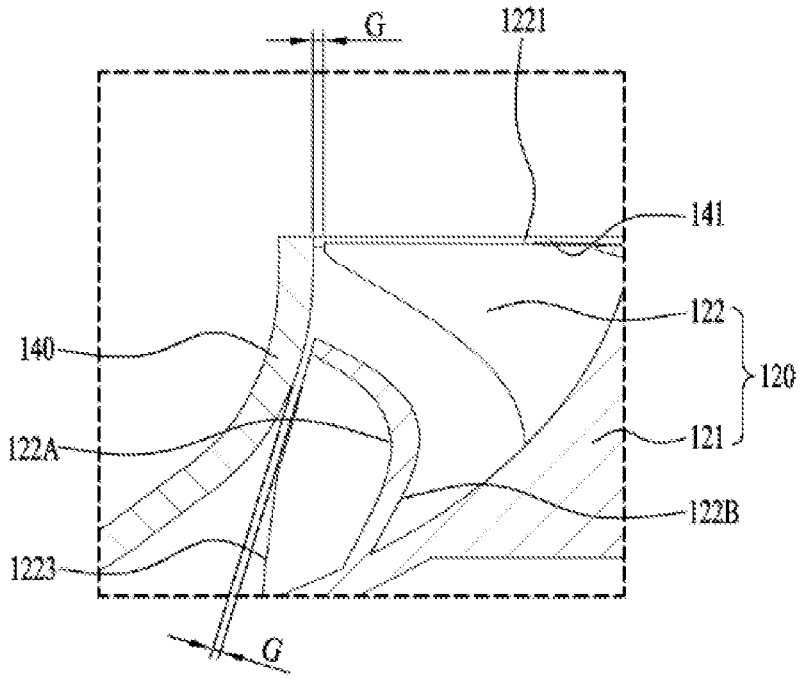
FIGS. 9A and 9B are cross-sectional views illustrating states of an impeller and an inlet body before forming a coating layer on the inlet body illustrated in FIG. 1.
Figure 9B:
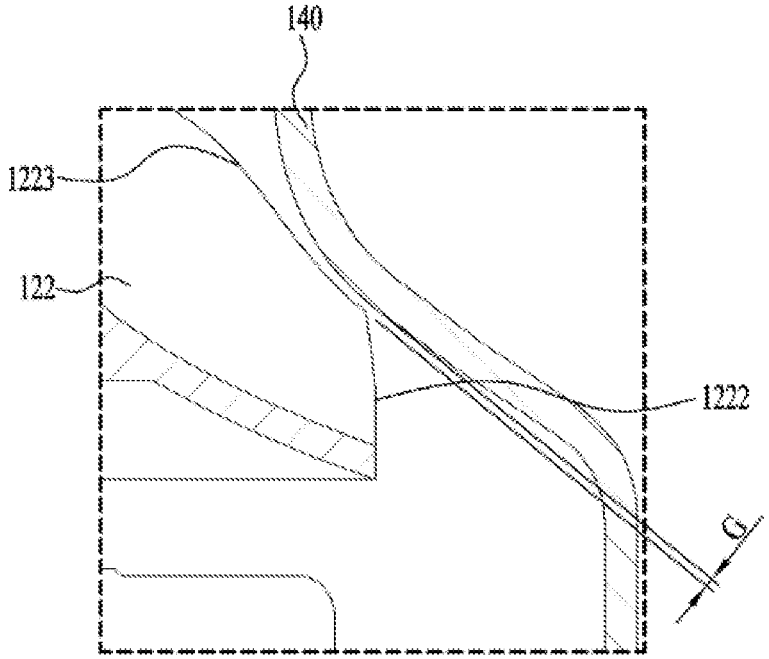
Figure 10A:
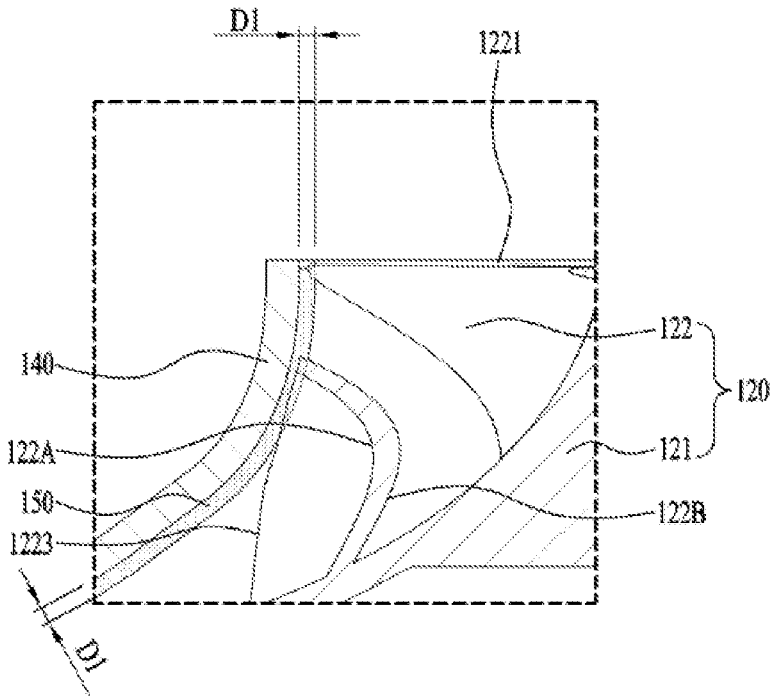
FIGS. 10A and 10B are cross-sectional views illustrating a state after forming the coating layer on an inner surface of the inlet body illustrated in FIGS. 9A and 9B.
Figure 10B:
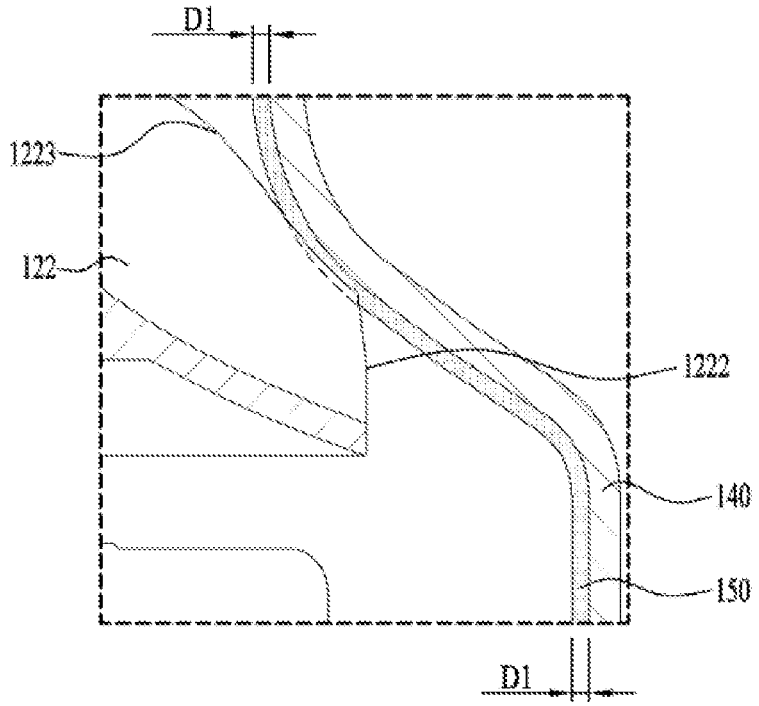
Figure 11:
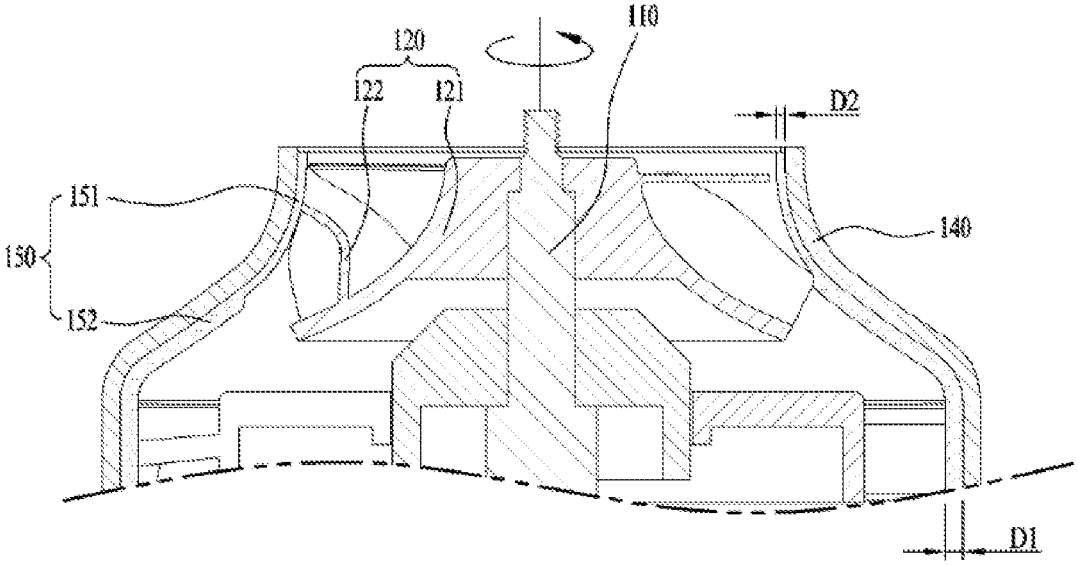
FIG. 11 is a cross-sectional view illustrating a state in which a portion of the coating layer is ground as the impeller rotates after forming the coating layer on the inner surface of the inlet body as illustrated in FIGS. 10A and 10B.

FIG. 7 is a flowchart schematically illustrating a method for forming a coating layer illustrated in FIG. 1. Further, FIG. 8 is a conceptual diagram schematically illustrating a state in which a coating layer is formed by applying paint on an inlet body illustrated in FIG. 1 using an electrostatic painting scheme. Further, FIGS. 9A and 9B are cross-sectional views illustrating states of an impeller and an inlet body before forming a coating layer on the inlet body illustrated in FIG. 1. Further, FIGS. 10A and 10B are cross-sectional views illustrating a state after forming the coating layer on an inner surface of the inlet body illustrated in FIGS. 9A and 9B. Further, FIG. 11 is a cross-sectional view illustrating a state in which a portion of the coating layer is ground as the impeller rotates after forming the coating layer on the inner surface of the inlet body as illustrated in FIGS. 10A and 10B.

Referring to FIG. 7, a method for manufacturing a motor assembly according to an embodiment of the present disclosure may include adsorbing a plurality of paint particles (see 150P of FIG. 8) to the inner surface of the inlet body 140 in the electrostatic painting scheme to form the coating layer 150 on the inner surface of the inlet body 140 (S701), inserting the impeller 120 having the plurality of blades 122 into the inlet body 140, and rotating the impeller 120 (S703), and grinding at least a portion of the coating layer 150 as the impeller 120 rotates (S705).

Referring to FIG. 8, in the electrostatic painting scheme, when a direct current high voltage 23 is applied to an electrostatic painting apparatus 21 in a state in which a discharge electrode (not shown) with a sharp tip is disposed to face the inner surface of the inlet body 140, corona discharge starts around the discharge electrode, and air around the discharge electrode is ionized, so that flow of ions 24 toward the inlet body 140 begins.

When paint 22 is sprayed to such ions 24, the ions 24 are attached to the sprayed paint particles 150P, so that the paint particles 150P are charged. The charged paint particles 150P move toward the inner surface of the inlet body 140 having an opposite polarity, and collide with the inner surface of the inlet body 140 to form the coating layer 150. In this connection, an average particle size of the paint particles 150P may be 20 to 150 μm.

Specifically, FIGS. 9A and 9B illustrate a state before the coating layer 150 is formed on the inner surface of the inlet body 140. That is, because the coating layer 150 is not yet formed on the inner surface of the inlet body 140, the tip clearance G may be defined between the blade tip 1223 of the impeller 120 and the inner surface of the inlet body 140.

FIGS. 10A and 10B illustrate a state immediately after the coating layer 150 is coated on the inner surface of the inlet body 140 in the electrostatic painting scheme as illustrated in FIG. 8. That is, the coating layer 150 illustrated in FIGS. 10A and 10B is yet to be ground by the rotation of the impeller 120, so that the coating layer 150 may have the constant thickness D1 along the inner surface of the inlet body 140. In other words, before rotating the impeller 120 (S703), the thickness of the ground portion 151 of the coating layer 150 facing the blade tip 1223 and the thickness of the residual portion 152 of the coating layer 150 may be substantially the same.

FIG. 11 shows a state in which the impeller 120 is inserted into the inlet body 140, and then the impeller 120 is rotated to grind a portion of the coating layer 150, in a state in which the coating layer 150 is formed on the inner surface of the inlet body 140 as shown in FIGS. 10A and 10B.

Specifically, because the leading edge 1221 and the trailing edge 1222 of the blade 122 do not face the inner surface of the inlet body 140, the leading edge 1221 and the trailing edge 1222 do not rub against the coating layer 150 when the impeller 120 rotates. On the other hand, because the blade tip 1223 of the blade 122 has a structure facing the inner surface of the inlet body 140, the blade tip 1223 rubs against the coating layer 150 when the impeller 120 rotates.

That is, a portion of the coating layer 150, which rubs against the blade tip 1223, is ground as the impeller 120 rotates, so that the ground portion 151 having the thickness D2 smaller than the thickness D1 of the residual portion 152 may be formed. Specifically, the coating layer 150 may include the ground portion 151, which is ground by the friction with the plurality of blades 122 when the impeller 120 rotates, and the residual portion 152, which maintains the thickness thereof because the friction with the plurality of blades 122 does not occur when the impeller 120 rotates.

In other words, after the step of rotating the impeller 120 (S703), in the process of grinding the ground portion 151 as the impeller 120 rotates, the thickness D2 of the ground portion 151 may be substantially equal to the thickness of the tip clearance G defined between the impeller 120 and the inlet body 140.

As such, when the ground portion 151 has the thickness D2 substantially corresponding to the tip clearance G defined between the blade tip 1223 and the inlet body 140 shown in FIGS. 9A and 9B, a flow path loss may be reduced by minimizing the leakage flow from the pressure-side surface 122A to the suction-side surface 122B of the blade 122 by the pressure difference, and the efficiency of the motor assembly 100 may be improved.

Further, even when there are an injection molding error of the blades 122 and an assembly tolerance of the motor assembly 100, such error or tolerance may be compensated based on a grinding depth of the coating layer 150, and the minimum tip clearance G may be maintained, so that the reliability of the motor assembly 100 may be improved.

In one example, the impeller 120 may contain the polyether ether ketone (PEEK), and the coating layer 150 may contain at least one of the ethylene tetra fluoro ethylene (ETFE) and the perfluoroalkoxy (PFA). In this connection, the polyether ether ketone (PEEK), which is the material of the impeller 120, has a higher surface hardness than at least one of the ethylene tetra fluoro ethylene (ETFE) and the perfluoroalkoxy (PFA), which is the material of the coating layer 150, so that the coating layer 150 may be smoothly ground when being ground by the rotation of the impeller 120.

Specifically, at least one of the ethylene tetra fluoro ethylene (ETFE) and the perfluoroalkoxy (PFA), which is the material of the coating layer 150, is the material that is ground to be in the form of the powder when being grounded, so that a portion of the coating layer 150 may be ground to be in the form of the powder without being ploughed or penetrated when the blades 122 are rotated.

Therefore, even when the thrust force of the impeller 120 increases during use of the motor assembly 100, and the impeller 120 approaches the coating layer 150, a portion of the remaining coating layer 150 (i.e., the residual portion 152) may be smoothly ground to cope with a sudden increase in the thrust force.

In addition, when the coating layer 150 is ground by the blades 122, the coating layer may be ground in the form of the powder, so that the coating layer may be accurately ground without being excessively ground.

In addition, because the coating layer 150 has a surface hardness smaller than that of the blades 122, even when the coating layer 150 is ground by the blades 122, there is no risk of the blades 122 being worn or broken by the coating layer.

In addition, because the coating layer 150 is made of the soft material, even when the output of the motor assembly 100 is somewhat low, the coating layer 150 may be smoothly ground.

Effects as not described herein may be derived from the above configurations. The relationship between the above-described components may allow a new effect not seen in the conventional approach to be derived.

In addition, embodiments shown in the drawings may be modified and implemented in other forms. The modifications should be regarded as falling within a scope of the present disclosure when the modifications are carried out so as to include a component claimed in the claims or within a scope of an equivalent thereto.

What is claimed is:

1. A motor assembly comprising:

a rotation shaft;

an impeller comprising a hub that is coupled to the rotation shaft and a plurality of blades that protrude outward from an outer surface of the hub;

an inlet body that surrounds an outer circumference of the impeller; and a coating layer disposed on an inner surface of the inlet body, the coating layer being at least partially ground by friction from contact with the plurality of blades during rotation of the impeller, wherein the impeller comprises polyether ether ketone (PEEK), and the coating layer comprises perfluoroalkoxy (PFA), and wherein a surface hardness of the coating layer is 50 to 75 shore D.

2. The motor assembly of claim 1, wherein the surface hardness of the coating layer is less than a surface hardness of the plurality of blades.

3. The motor assembly of claim 1, wherein the coating layer has:

a first portion having a first thickness that is greater than a width of a gap defined between the impeller and the inlet body; and a second portion having a second thickness corresponding to the width of the gap defined between the impeller and the inlet body.

4. The motor assembly of claim 1, wherein the coating layer comprises:

a ground portion that is ground by friction from contact with the plurality of blades during the rotation of the impeller; and a residual portion that is not ground by friction from contact with the plurality of blades during the rotation of the impeller and that maintains a first thickness of the coating layer.

5. The motor assembly of claim 4, wherein a second thickness of the ground portion corresponds to a width of a gap defined between the impeller and the inlet body.

6. The motor assembly of claim 5, wherein the first thickness of the residual portion is greater than the width of the gap defined between the impeller and the inlet body.

7. The motor assembly of claim 4, wherein each of the plurality of blades comprises:

a leading edge positioned at a front end of the blade with respect to a flow direction of gas in the inlet body;

a trailing edge positioned at a rear end of the blade; and a blade tip that connects the leading edge to the trailing edge and that faces the inner surface of the inlet body, and wherein the ground portion is ground by friction from contact with the blade tip during the rotation of the impeller.

8. The motor assembly of claim 1, wherein the coating layer comprises a plurality of paint particles that are adsorbed on the inner surface of the inlet body by electrostatic painting, and wherein an average particle size of the plurality of paint particles is 20 to 150 μm.

9. The motor assembly of claim 1, wherein the impeller and the inlet body are spaced apart from each other and define a gap therebetween, the gap varying along a flow direction of gas in the inlet body, and wherein a thickness of the coating layer varies along the flow direction of gas in the inlet body according to the gap defined between the impeller and the inlet body.

10. The motor assembly of claim 1, wherein the coating layer comprises an interface that is attached to the inner surface of the inlet body and that remains attached to the inner surface of the inlet body during the rotation of the impeller.

11. The motor assembly of claim 1, further comprising a bearing bracket disposed below the impeller and coupled to the rotation shaft, wherein a bottom surface of the hub is recessed upward and receives an upper portion of the bearing bracket.

12. The motor assembly of claim 1, wherein the rotation shaft protrudes through an upper surface of the impeller.

13. A method for manufacturing a motor assembly, the motor assembly including an impeller that includes a plurality of blades and an inlet body that surrounds an outer circumference of the impeller, the method comprising:

forming a coating layer on an inner surface of the inlet body, wherein forming the coating layer comprises adsorbing a plurality of paint particles on the inner surface of the inlet body by electrostatic painting;

based on forming the coating layer, inserting the impeller into the inlet body; and rotating the impeller in the inlet body to thereby at least partially grind the coating layer, wherein the impeller comprises polyether ether ketone (PEEK), and the coating layer comprises perfluoroalkoxy (PFA), and wherein a surface hardness of the coating layer is 50 to 75 shore D.

14. The method of claim 13, wherein rotating the impeller comprises rotating the impeller relative to the inlet body to thereby grind the at least a portion of the coating layer into powder.

15. The method of claim 13, wherein the surface hardness of the coating layer is less than a surface hardness of the plurality of blades.

16. The method of claim 13, wherein an average particle size of the plurality of paint particles is 20 to 150 μm.

17. The method of claim 13, wherein forming the coating layer comprises:

coating the coating layer on the inner surface of the inlet body to a first thickness that is greater than a width of a gap defined between the impeller and the inlet body, and wherein rotating the impeller comprises:

defining (i) a ground portion in the coating layer that is ground by friction from contact with the plurality of blades and (ii) a residual portion in the coating layer that is not ground by friction from contact with the plurality of blades and that maintains the first thickness.

18. The method of claim 17, wherein defining the ground portion comprises:

rotating the impeller relative to the inlet body to thereby reduce a thickness of the coating layer from the first thickness.

19. The method of claim 17, wherein defining the ground portion comprises:

rotating the impeller relative to the inlet body to thereby reduce a thickness of a portion of the coating layer from the first thickness to a second thickness that corresponds to the width of the gap defined between the impeller and the inlet body.

* * * * *